US006851379B2

(12) United States Patent
Black

(10) Patent No.: US 6,851,379 B2
(45) Date of Patent: Feb. 8, 2005

(54) PORTLIGHT ASSEMBLY

(75) Inventor: James W. Black, Tampa, FL (US)

(73) Assignee: Jim Black & Associates, Inc., Tampa, FL (US)

( * ) Notice: Subject to any disclaimer, the term of this patent is extended or adjusted under 35 U.S.C. 154(b) by 0 days.

(21) Appl. No.: 10/456,072

(22) Filed: Jun. 6, 2003

(65) Prior Publication Data

US 2004/0244666 A1 Dec. 9, 2004

(51) Int. Cl.[7] ..... B63B 19/08

(52) U.S. Cl. ..... 114/177; 49/400; 49/504; 114/178

(58) Field of Search ..... 114/173, 176, 114/177, 178; 49/400, 504

(56) References Cited

U.S. PATENT DOCUMENTS

| | | | | |
|---|---|---|---|---|
| 7,927 A | | 2/1851 | Goodrich | |
| 552,536 A | | 1/1896 | Mackenzie et al. | |
| 631,292 A | | 8/1899 | Fyte et al. | |
| 922,508 A | | 5/1909 | Puffer | |
| 4,095,640 A | | 6/1978 | Beckerer | |
| 4,376,418 A | * | 3/1983 | Childs | 114/178 |
| 4,976,212 A | | 12/1990 | Camaruta | |
| 5,150,943 A | | 9/1992 | Gold | |
| 6,105,320 A | | 8/2000 | Boor et al. | |
| 6,451,398 B1 | * | 9/2002 | Sylvester | 428/41.8 |

* cited by examiner

*Primary Examiner*—Sherman Basinger
(74) *Attorney, Agent, or Firm*—Carlton Fields, P.A.

(57) ABSTRACT

A portlight assembly for installation in an opening in a wall of a vessel includes an outer frame having a flange and a cylindrical wall portion extending from the flange, with the flange overlying a portion of the outer surface of the vessel wall surrounding the opening and the cylindrical wall portion extending through the opening, a window mounted to the outer frame. It further includes an inner securing ring threadedly received onto a threaded section of the cylindrical wall portion and overlying a portion of the inner surface of the vessel wall. The outer frame includes an initial attachment structure for holding the outer frame in place within the vessel wall opening until the inner securing ring is threaded onto the cylindrical wall portion.

14 Claims, 8 Drawing Sheets

PORTLIGHT ASSEMBLY

FIELD OF THE INVENTION

The present invention relates to portlights, or opening ports, for use with a marine vessel or the like, and more particularly to such a portlight that provides for simplified installation into the hull of a vessel.

BACKGROUND OF THE INVENTION

Portlight assemblies for marine vessels and other vehicular bodies are well known in the art and are available from numerous sources. Such port assemblies typically include an aluminum or plastic frame, a transparent window of either glass or polycarbonate and an inner mounting structure through which screws are inserted, which then pass through the hull and are threaded into the outer frame.

One difficulty associated with conventional portlight assemblies has been the common requirement of at least two workers to install each unit. Conventionally, one worker inserted the frame, along with its gasketing and sealing material, through an opening in the side of the hull or cabin of the vessel, and then a second worker on the inside of the vessel inserted a retaining structure over the portion of the frame extending through the vessel wall and inserted and tightened screws through the inner ring into the outer frame. This requirement for the use of two persons to assemble each portlight onto the vessel has substantially increased both assembly time and, most notably, the expense of requiring two workers for each installation. Substantial savings could be realized if such a portlight assembly were structured to permit its installation by a single worker.

SUMMARY OF THE INVENTION

The present invention comprises a portlight assembly for installation in combination with an opening in the wall of a vessel, in which the portlight assembly comprises an outer frame having a flange and a cylindrical wall portion extending from that flange, with the flange overlying a portion of the outer surface of the vessel wall surrounding the opening, and the cylindrical wall portion extends through the opening and includes a threaded section distal that flange. The assembly further comprises a window mounted to the outer frame and having an inner surface and an outer surface, an inner securing ring threadedly received onto a threaded portion of the cylindrical wall portion distal the flange and overlying a portion of the inner surface of the vessel wall, such inner securing ring included threads engaging the threaded section of the cylindrical wall portion. The outer frame includes initial attachment means for holding the outer frame in place within the vessel wall opening pending threaded receipt of that inner securing ring onto the cylindrical wall portion.

BRIEF DESCRIPTION OF THE DRAWINGS

A particularly preferred embodiment of the portlight assembly of this invention is illustrated in the figures, in which.

DESCRIPTION OF PREFERRED EMBODIMENTS

Figure 1:
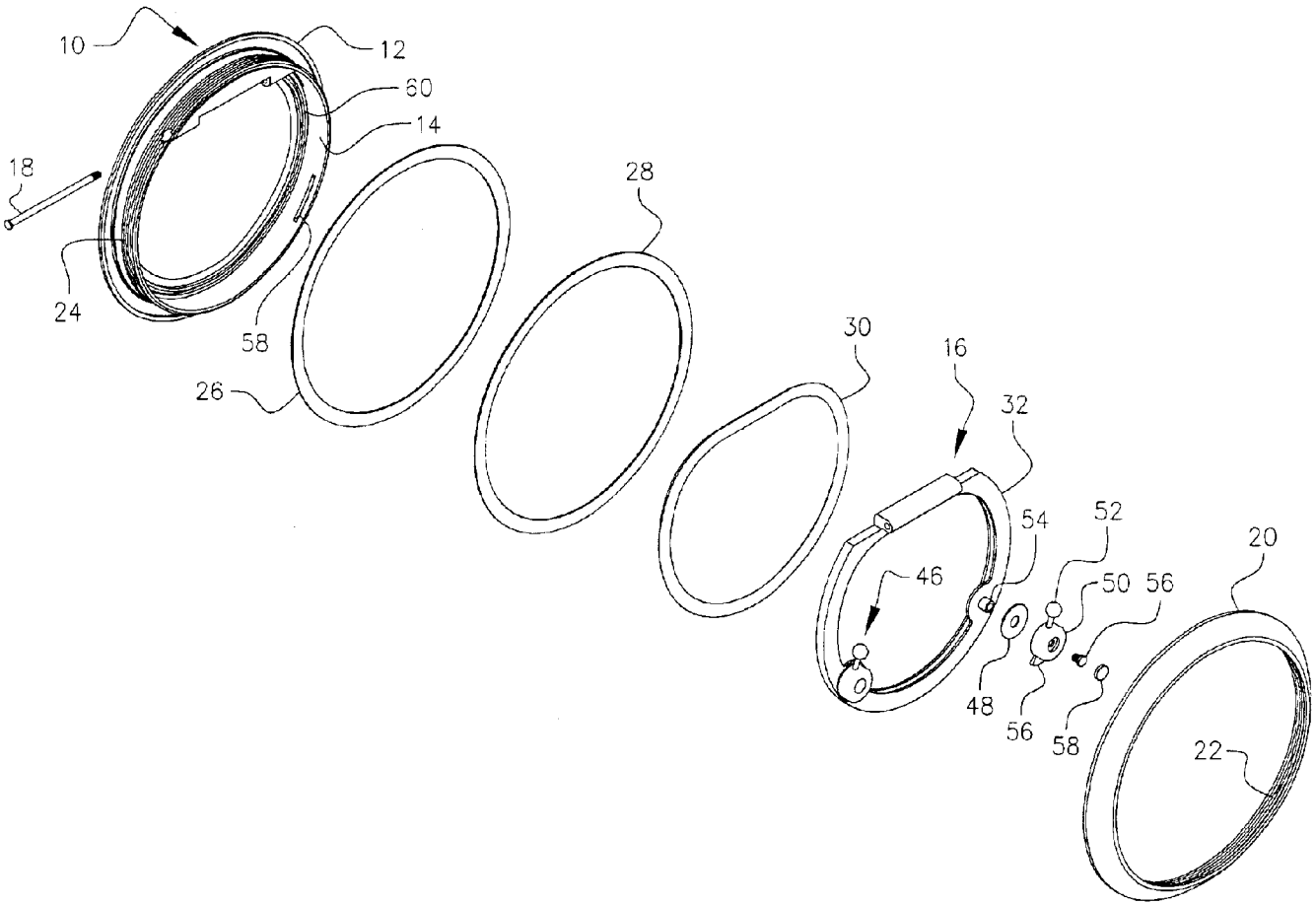
FIG. 1 is an exploded view the components of the portlight assembly of this invention, but without illustration of the vessel hull.
Figure 2:
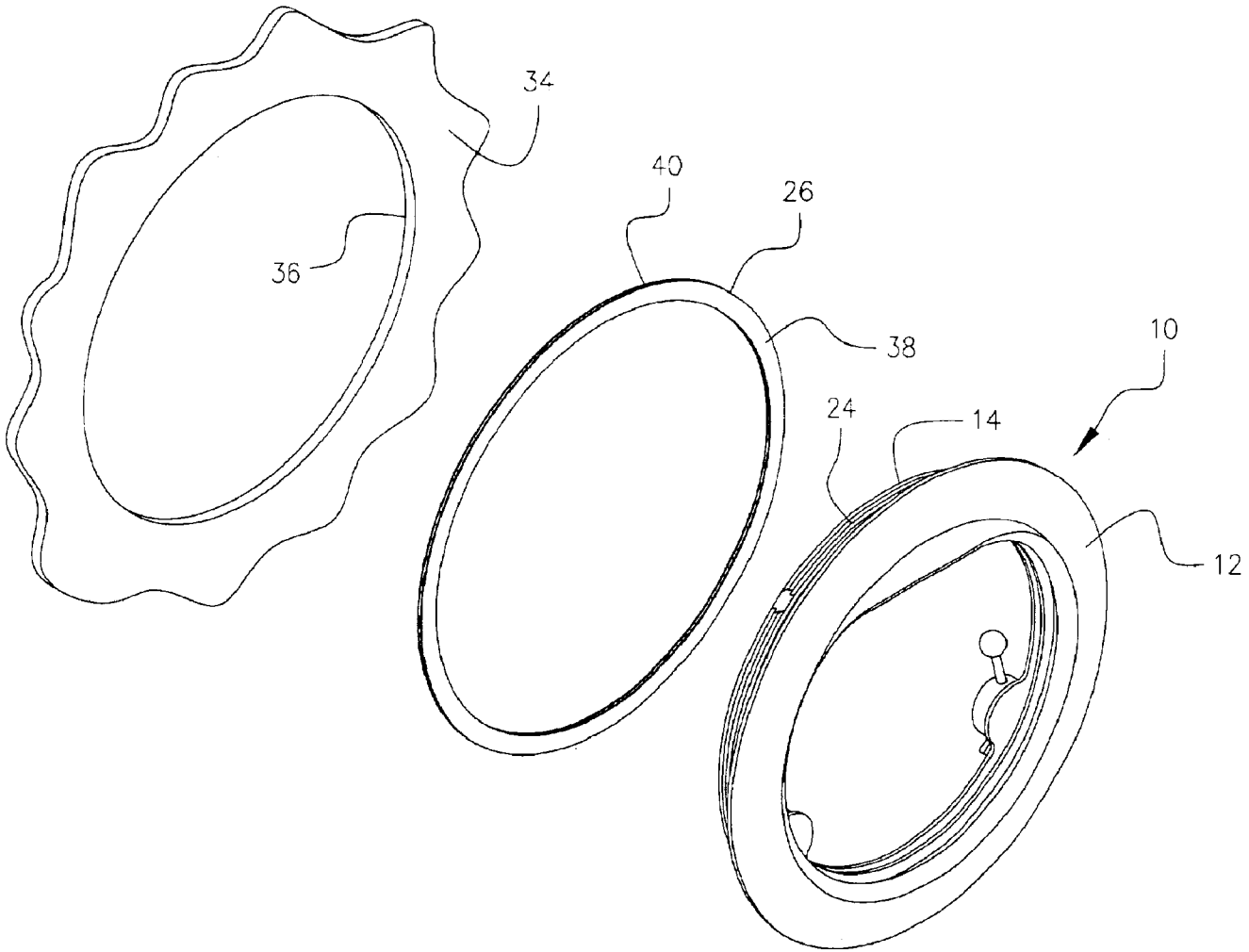
FIG. 2 is an illustration of a fragmentary portion of the exterior of a boat hull and the components of the portlight assembly of FIG. 1 that go on the outside of the vessel wall.
Figure 3:
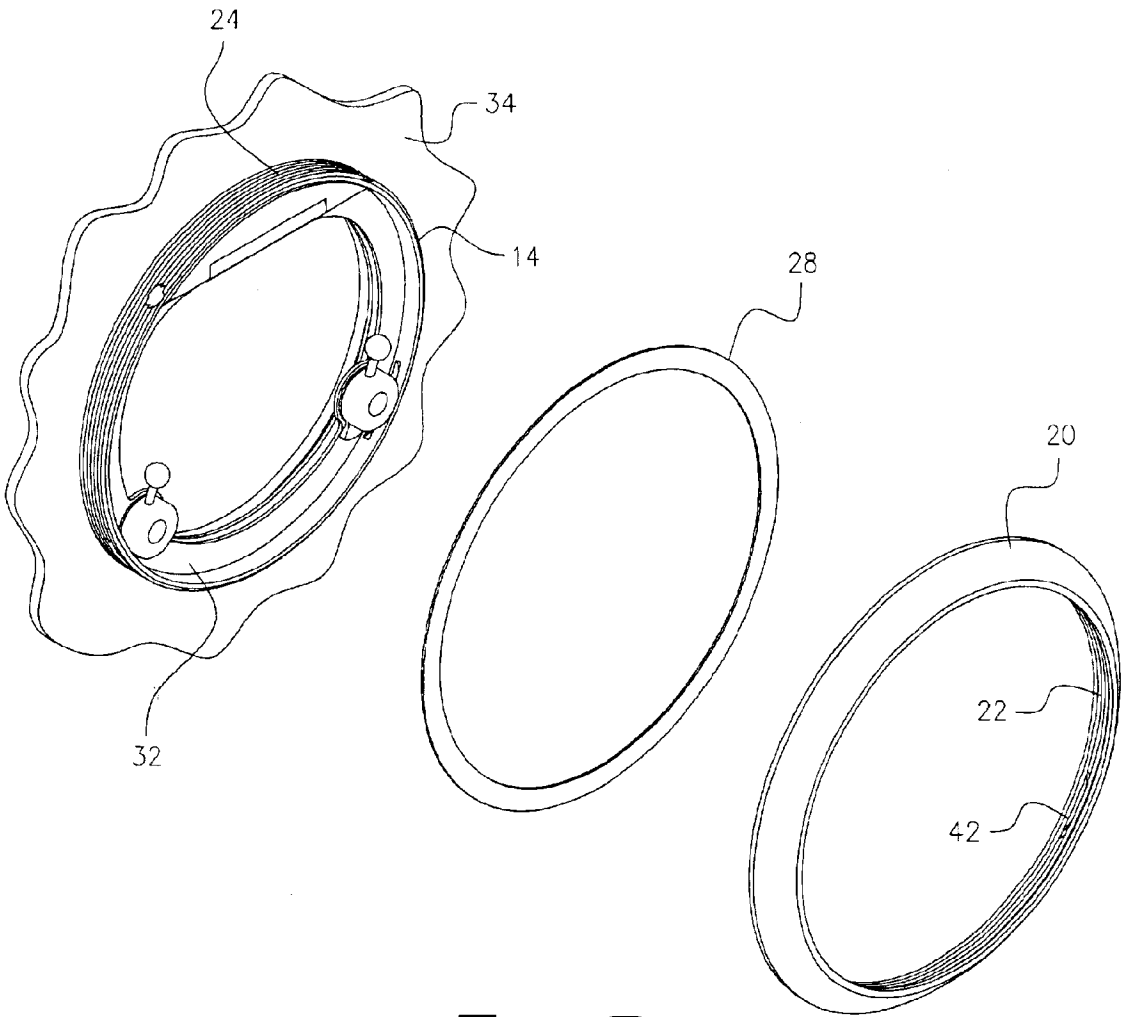
FIG. 3 illustrates the manner in which the inner components are assembled onto the portlight assembly of FIG. 1.
Figure 4:
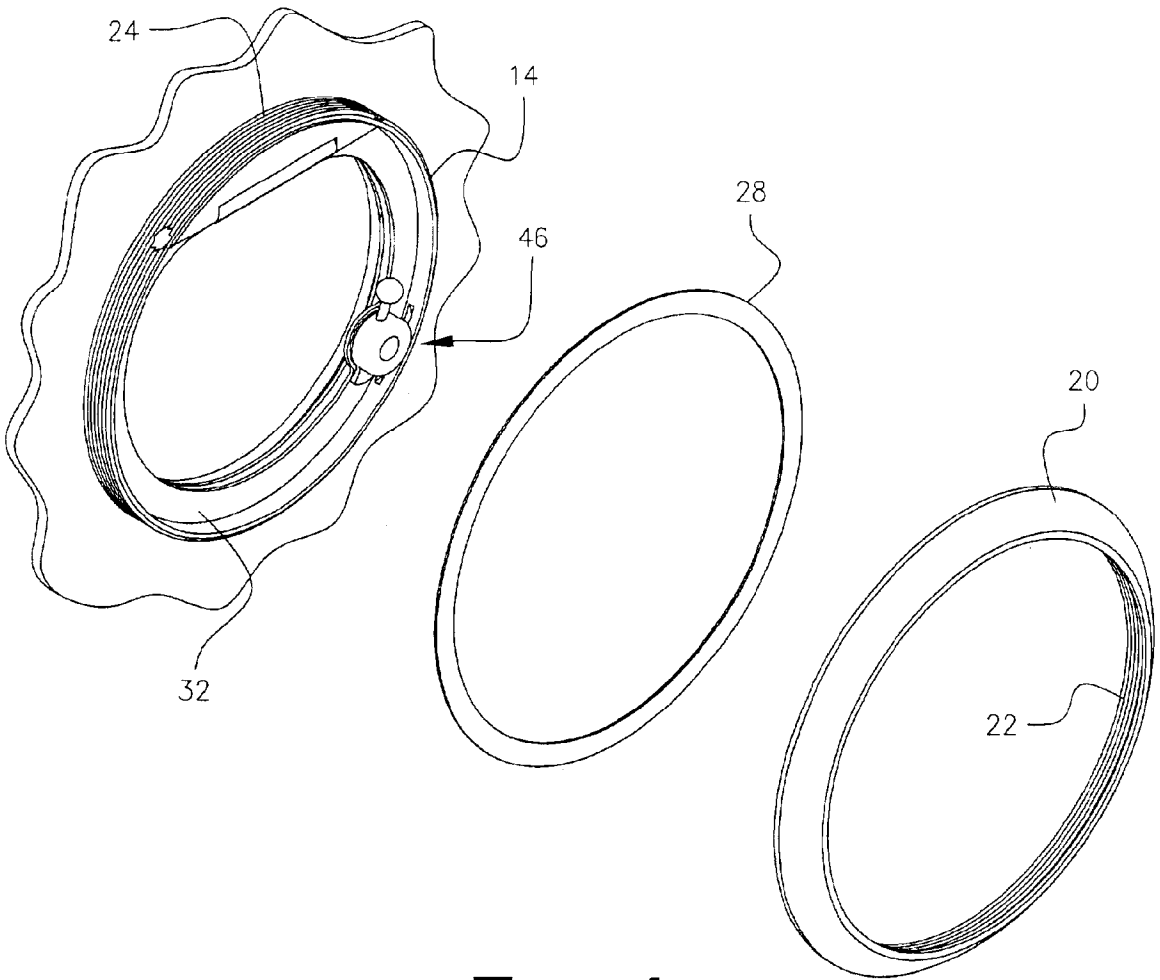
FIG. 4 is an exploded view of the interior components of a slightly different embodiment of the opening portlight of this invention in which a single locking assembly is used to hold the window closed instead of two such locking assemblies.

An exploded view of the components of one embodiment of a port assembly according to this invention is shown in FIG. 1. In general, the assembly comprises an outer frame 10 having a flange 12 and a cylindrical wall portion 14 extending from the flange. This assembly may be fabricated of any convenient rigid material, including, without limitation, stainless steel, aluminum, or a generally rigid synthetic resin. A window 16 is mounted to the frame, suitably by means of a pin 18 extending through holes in bosses on the frame 10 and the window 16. An inner securing ring 20 is received onto the cylindrical wall portion 14 of the outer frame 10 and includes threads 22 engaging corresponding threads 24 on the cylindrical wall portion 14 of the outer frame. There is also provided initial attachment means 26, suitably in the form of a double-faced adhesive material, which may take the form of a gasket that engages both a portion of the flange 12 of the outer frame 10 and the vessel wall at the time of installation, for holding that outer frame in place within an opening in the vessel wall pending threaded receipt of that inner securing ring 20 onto the cylindrical wall portion. An additional resilient gasket 28 may also be provided for engagement between the inner surface of the vessel wall and the inner securing ring 20, and a window sealing gasket 30 may be received within the outer frame for sealing engagement against the frame 32 of the window assembly 16. The manner of installation of this portlight assembly is shown in FIGS. 2 through 4. FIG. 2 illustrates the outer frame, within which is installed the window assembly 16 and window sealing gasket 30, the initial attachment means 26 and a fragmentary portion of the wall 34 of the vessel into which it is to be installed. An opening 36, suitably of dimensions slightly greater than the outer dimensions of the cylindrical wall portion 14 of the outer frame 10, is provided through the vessel wall. Preferably, the cylindrical wall portion 14 of the outer frame is of circular configuration, as shown. The initial attachment means 26 preferably is of the configuration of a flat circular ring having an inner diameter slightly greater than the outer diameter of the threads 24 of the cylindrical wall portion and an outer diameter less than the outer diameter of the outer frame flange 12. Preferably, this flat ring 26 is formed of a resilient material, such as a synthetic foam, and has the opposing sides 38 and 40 coated with an adhesive material and preferably covered by a release paper until the ring is to be used. When it is to be used, any such release paper is removed from the surface 38 facing the portlight assembly outer frame, and the ring is placed over the cylindrical wall portion 14 and brought into bonding engagement with the surface of the flange 12 that is directed toward the vessel wall 34. The next step in the installation would be the removal of any release paper covering the adhesive on the side 40 of the initial attachment ring 26 that faces toward the vessel wall. Then, the outer frame may be inserted though the opening 36 in the vessel wall 34 such that the adhesive on the surface 40 of that initial attachment ring then engages the surface of the vessel wall 34 surrounding that opening 36 to retain the outer frame in place within that opening, as shown on FIGS. 3 and 4.

Figure 5:
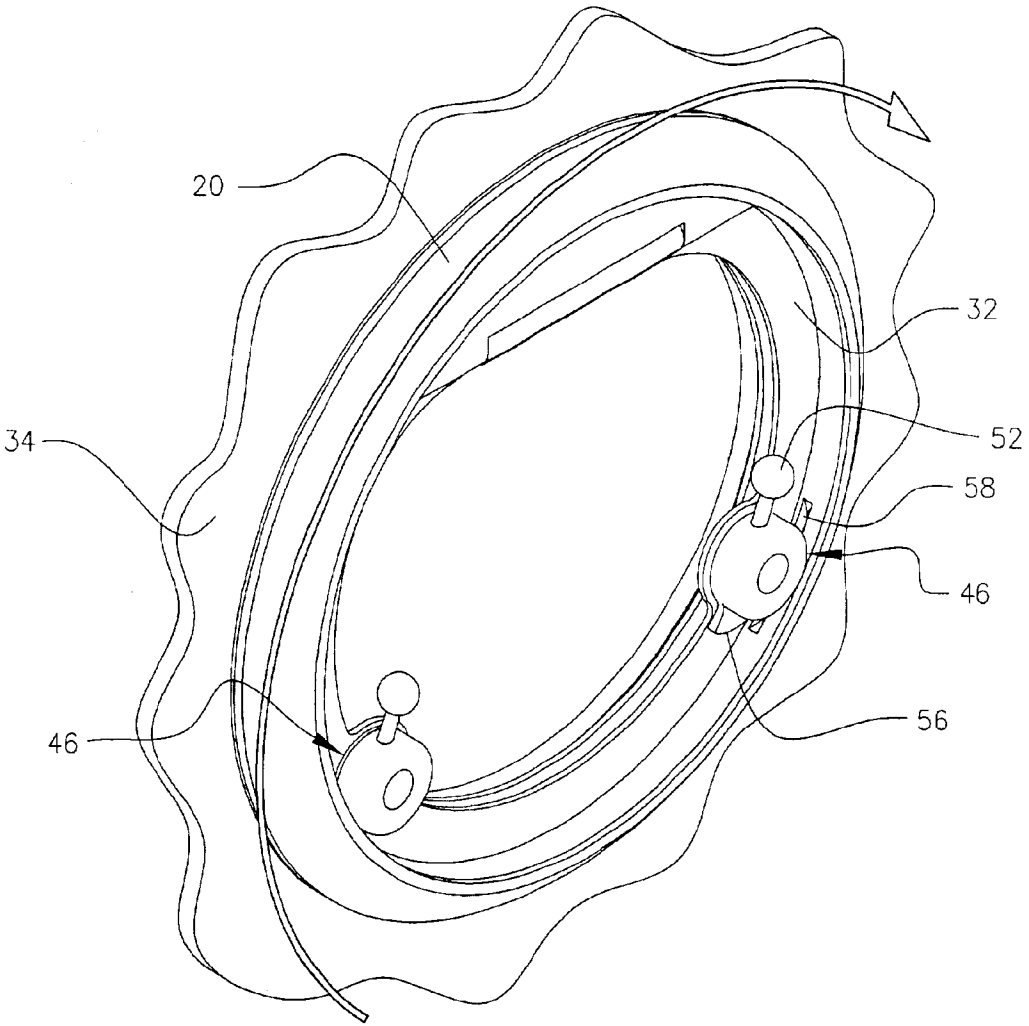
FIG. 5 illustrates the apparatus of FIGS. 1 through 4 assembled together.

FIGS. 3 and 4 illustrate the subsequent steps in installation of the portlight assembly, in which the outer frame is initially attached or held in place within the opening through the hull by means of the adhesive ring 26, as described above. As shown in FIGS. 3 and 4, the threaded section 24 of the cylindrical wall portion 14 extends through the vessel wall. Over this cylindrical wall portion is placed a resilient sealing gasket 28 of any suitable resilient, waterproof material, such as a resilient synthetic foam, and then the inner securing ring 20 is threaded onto the threaded section 24 of the outer frame cylindrical wall portion 14. This inner securing ring may be tightened by rotation of the ring, suitably in a clockwise direction as shown by the arrow in FIG. 5, by any conventional means, such as a spanner wrench or the like.

Figure 6:
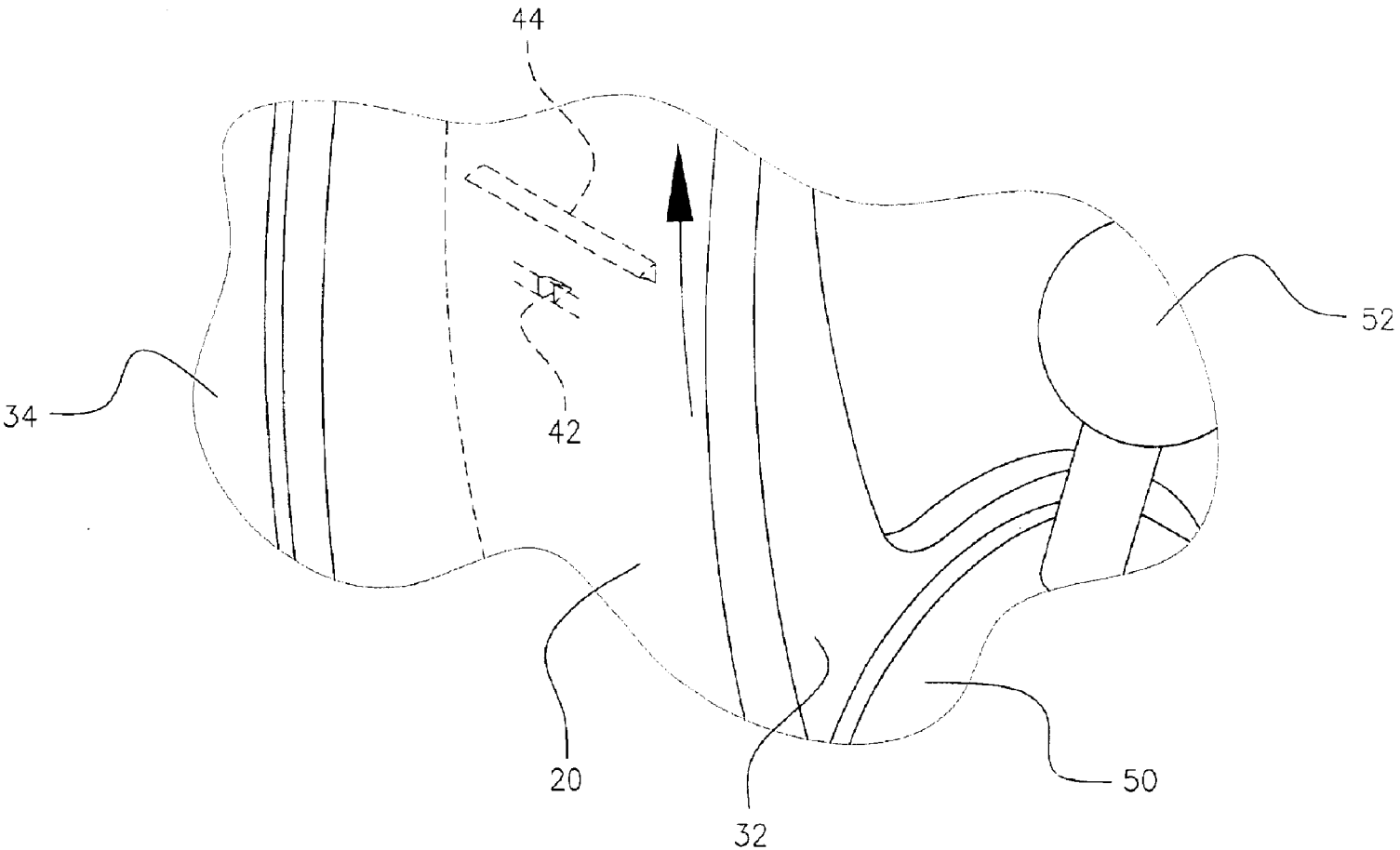
FIG. 6 is a fragmentary sectional view of the portlight of this invention, illustrating a mechanism to hold an inner securing ring in place without unscrewing.

To assist in retaining the inner securing ring 20 in position, there preferably is provided a locking structure, suitably including a first component carried by the cylindrical wall portion and a second component carried by the inner securing ring and engaging that first locking structure component to permit rotation of the inner securing ring in a first direction to tighten engagement between the inner securing ring 20 and the vessel wall, while resisting rotation in a second, opposite direction. Suitably, this first locking structure component carried on the cylindrical wall portion 14 of the outer frame may comprise a first portion of a ratchet mechanism, such as a groove or slot, shown in phantom and identified by reference numeral 44 in FIG. 6 as suitably a slot or groove formed across the threads of the cylindrical wall portion 14 of the outer frame. The second locking structure component carried by the inner securing ring 20 may suitably comprise a second, mutually engaging portion of a ratchet mechanism, such as a resilient tooth shown in phantom and identified by reference numeral 42 in FIG. 3 and FIG. 6. Thus, mutual engagement between the two ratchet mechanism portions 42 and 44 permits the inner securing ring 20 to be ratcheted into tightening engagement with the cylindrical wall portion 14 against the inner surface of the vessel wall and to resist loosening rotation of that inner securing ring in the opposite direction.

As noted above, the window frame assembly 16 is pivotally mounted to the outer frame by pivot pin 18. This permits pivotal movement of the window about a pivot axis, such as defined by the pivot pin 18, between a closed position shown in FIG. 7 and an open position, shown in FIG. 8.

In order to selectively and releaseably hold the window in the closed position, there is provided at least one latch assembly 46, as shown in FIG. 4, and preferably two such assemblies, as shown in FIGS. 1, 3, 5, 7 and 8. While the latch structure may take any of a number of equivalent forms, one preferred embodiment is shown best in the exploded view of FIG. 1. This preferred embodiment of the latching assembly 46 may suitably include a flat, friction reducing washer 48 and a frame engaging member 50, to which is mounted an actuating knob 52, with these components being received over a pivotal mounting, such as journal 54, extending generally normal to and carried by the window frame 32. Suitably, a bolt or other fastener extends through the frame engaging member 50 and washer 48 and is threadedly received into the journal 54 forming the pivotal mount. For aesthetic purposes, a plug may be provided to hide the bolt 56 as it extends through the frame engaging member 50 and washer 48 into the pivotal mounting in the form of the journal 54. This window frame engaging member 50 may conveniently have an angularly ramped portion 56 extending generally radially outwardly from the pivotal mounting journal 54 and configured so that it engages a latching portion 58 of the outer frame. This latching portion 58 may conveniently be in the form of an opening or slot dimensioned to receive the angularly ramped portion 56 of the latch.

Figure 7:
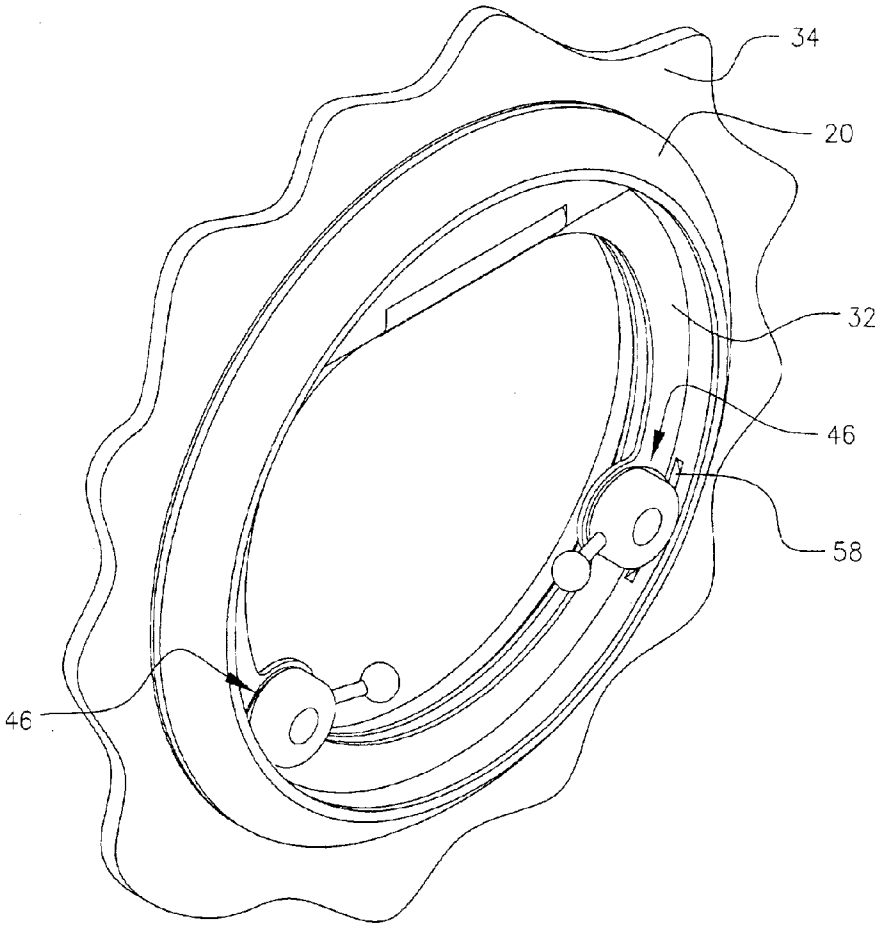
FIG. 7 is a view, taken on the inside of the vessel hull, illustrating the portlight in its installed configuration.
Figure 8:
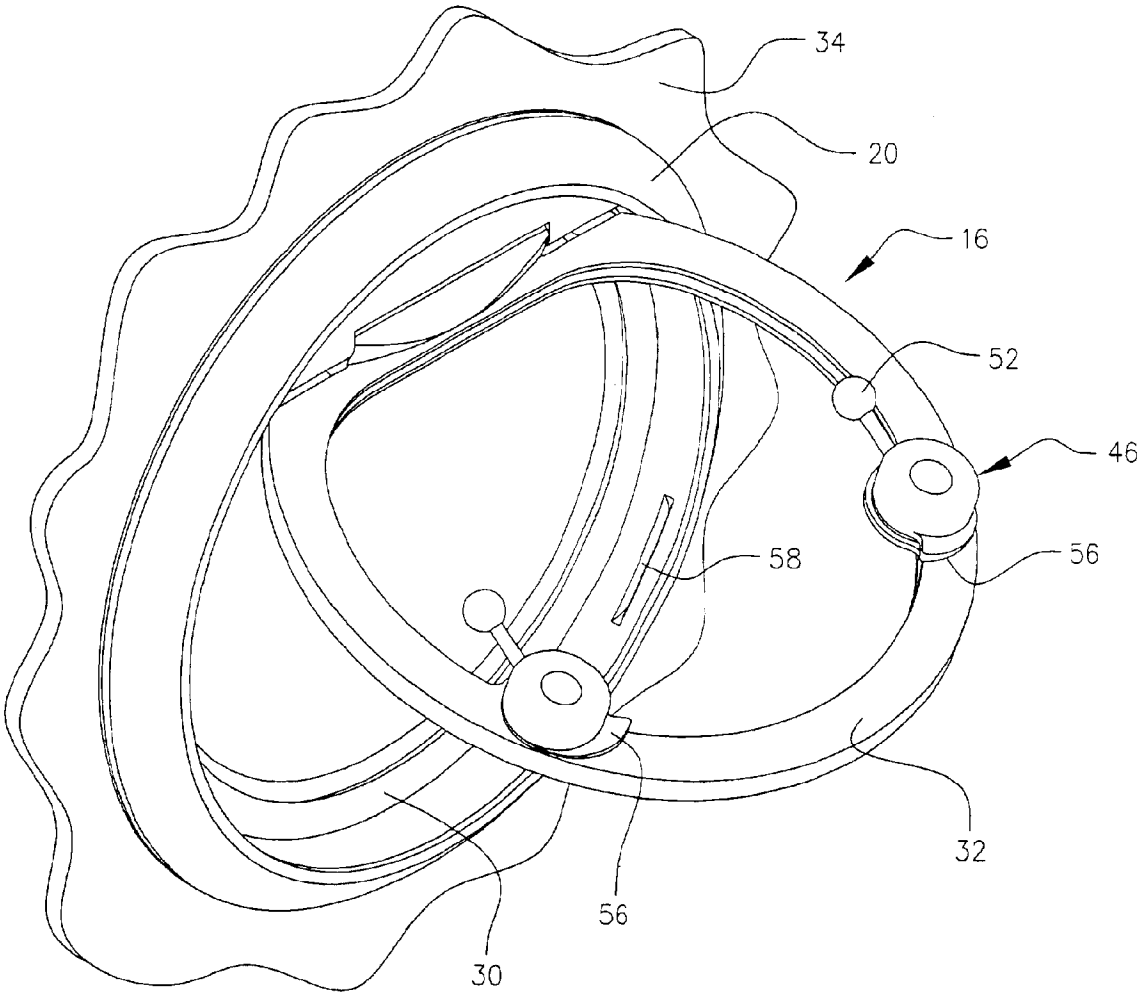
FIG. 8 is a representation similar to that of FIG. 7, but with the window open.

As shown in FIG. 7, when the window frame 32 is pivoted to its closed position, engaging sealing gasket 30, the latches 46 may be pivoted to bring the angularly ramped portion 56 into the slot 58. When it is desired to open the window 16, the latches 46 are pivoted to withdraw the angularly ramped portions 56 from engagement with the latching portion 58 of the frame.

The outer frame 10 includes around its radially inner periphery a lip 60 for engaging the window in the frame 32 when that window is in its closed position. This lip also may have mounted to it a sealing gasket 30 for establishing a generally watertight seal between the outer frame lip 60 and the window, when the window is in the closed position.

While the foregoing describes a particularly preferred embodiment of the portlight assembly of the present invention, it should be understood that such description is illustrative only of the principles of the invention and is not be considered limitative thereof. Accordingly, since numerous variations and modifications of the specific structure, all within the scope of the invention, were readily occurred to those skilled in the art, the scope of this invention is to be limited solely by the claims appended hereto.

What is claimed is:

1. A portlight assembly for installation in combination with an opening in a wall of a vessel, comprising a vessel having a wall with an opening through said wall;

a portlight outer frame having a flange and a cylindrical wall portion extending from said flange, said flange overlying a portion of the outer surface of said vessel wall surrounding said wall opening, said cylindrical wall portion extending through said vessel wall opening and including a threaded section distal said flange, a window mounted to said outer frame and having an inner surface and an outer surface, an inner securing ring threadedly received onto said threaded section of said cylindrical wall portion and overlying a portion of the inner surface of said vessel wall, said inner securing ring including threads engaging said threaded section of said cylindrical wall portion, said outer frame including initial attachment means for holding said outer frame in place within said vessel wall opening pending threaded receipt of said inner securing ring onto said cylindrical wall portion, a first locking structure carried by said inner securing ring, and a second locking structure carried by said cylindrical wall portion and engaging said first locking structure to permit rotation of said inner securing ring in a first direction to tighten engagement between said inner securing ring and said vessel wall while resisting rotation in a second, opposite direction.

2. The portlight assembly of claim 1, wherein said initial attachment means is external to said vessel wall.

3. The portlight assembly of claim 1 wherein said initial attachment means comprises an adhesive material.

4. The portlight assembly of claim 3 wherein said adhesive material comprises a resilient material having two opposing faces and an adhesive coating on each of said two opposing faces.

5. The portlight assembly of claim 1 wherein said window comprises a light-transmissive portion carried within a supporting frame, which frame is pivotally mounted to said outer frame.

6. The portlight assembly of claim 1 wherein said first locking structure comprises a first portion of a ratchet mechanism, and said second locking structure comprises a second, mutually engaging portion of a ratchet mechanism, whereby mutual engagement between the two ratchet mechanism portions permits the inner securing ring to be ratcheted into tightening engagement with the cylindrical wall portion, against the inner surface of the vessel wall, and to resist loosening rotation of the inner securing ring.

7. The portlight assembly of claim 1 wherein said window is pivotally mounted to said outer frame to permit pivotal movement of said window, about the pivot axis, between a closed position and an open position.

8. The portlight assembly of claim 7 further comprising at least one latch attached to said window to selectively and releaseably hold said window in said dosed position.

9. The portlight assembly of claim 8 wherein said latch is mounted to said outer frame.

10. The portlight assembly of claim 8 wherein said latch is pivotally mounted for rotational movement about an axis generally normal to the inner surface of said window, between a first position holding said window in said closed position and a second position in which said window may be selectively moved to said open position.

11. The portlight assembly of claim 10 further comprising said latch including a window frame-engaging member extending generally radially outwardly from said pivotal mounting, and said outer frame cylindrical wall portion including an opening for receiving said latch frame-engaging member when said latch is pivotally moved to said first position, with said latch window frame-engaging member engaging a latching portion of said frame adjacent said opening.

12. The portlight assembly of claim 11 wherein said frame-engaging member of said latch includes an angularly ramped portion configured such that said ramped portion engages said latching portion of said frame as said latch is rotated from said second position to said first position, whereby rotation of said latch about said axis secures the window in its closed position.

13. The portlight assembly of claim 1 wherein said outer frame further comprises a lip for engaging said window when said window is in a closed position.

14. The portlight assembly of claim 13 wherein said lip includes a sealing gasket for establishing a generally watertight seal between said outer frame lip and said window when said window is in said dosed position.

* * * * *